US011160406B2

(12) United States Patent
Strassburger

(10) Patent No.: US 11,160,406 B2
(45) Date of Patent: Nov. 2, 2021

(54) DISPLAY HANGER FOR SLIDE STYLE SHOES

(71) Applicant: B&G Plastics, Inc., Union, NJ (US)

(72) Inventor: Jacob Strassburger, South Plainfield, NJ (US)

(73) Assignee: B&G International Products Ltd., Kowloon (HK)

( * ) Notice: Subject to any disclaimer, the term of this patent is extended or adjusted under 35 U.S.C. 154(b) by 241 days.

(21) Appl. No.: 16/577,245

(22) Filed: Sep. 20, 2019

(65) Prior Publication Data

US 2020/0093307 A1 Mar. 26, 2020

Related U.S. Application Data

(60) Provisional application No. 62/736,532, filed on Sep. 26, 2018.

(51) Int. Cl.
*A47G 25/00* (2006.01)
*A47F 7/08* (2006.01)

(52) U.S. Cl.
CPC ..... *A47G 25/005* (2013.01); *A47F 7/08* (2013.01)

(58) Field of Classification Search
CPC ..... A47G 25/005; A47G 25/10; A47G 25/14; A47G 25/28; A47G 25/30; A47G 25/74; A47G 25/743; A47G 25/746; A47G 7/04; A47F 7/08; A47F 7/10; B65D 85/187; E05B 69/003
USPC ..... 211/34, 35
See application file for complete search history.

(56) References Cited

U.S. PATENT DOCUMENTS 1,663,388 A * 3/1928 Rona ..... A45C 3/12 383/38
2,267,634 A * 12/1941 Arenz ..... A47L 23/20 211/34
2,546,600 A * 3/1951 Holden ..... A47G 25/743 223/85
2,703,651 A * 3/1955 Brocklehurst ..... A47L 23/20 211/34
2,939,588 A * 6/1960 Nalle, Jr. ..... D06F 59/00 211/113

(Continued)

FOREIGN PATENT DOCUMENTS

EP 1616512 A1 * 1/2006 ..... A47G 25/005

*Primary Examiner* — Jonathan Liu
*Assistant Examiner* — Devin K Barnett
(74) *Attorney, Agent, or Firm* — Hoffmann & Baron, LLP

(57) ABSTRACT

A display hanger for slides includes a body member and a holder configured to engage and attach to the body member. The body member includes a display hanger hook, an elongated central member connected to the display hanger, a bottom member connected to the central member, and opposed first and second side members connected to each side of the bottom member and extend laterally therefrom and then extend upwardly such that first and second clips are formed, respectively. The holder has parallel first and second longitudinal side walls and parallel first and second transverse side walls. The longitudinal side walls and transverse side walls are integrally connected to each other to form a generally rectangular frame having an open space in the middle. The display hanger further includes a bungee cord for keeping the slides with the display hanger while a customer tries them on.

12 Claims, 8 Drawing Sheets

(56) References Cited

U.S. PATENT DOCUMENTS 3,478,942 A * 11/1969 English ..... A47F 7/19 223/85
3,802,572 A * 4/1974 Shackel ..... A47G 25/005 211/38
4,714,156 A * 12/1987 Kolton ..... A47G 25/14 206/278
4,765,467 A * 8/1988 Kolton ..... A47G 25/743 206/278
4,768,649 A * 9/1988 Kolton ..... A47G 25/743 206/278
4,768,657 A * 9/1988 Lonow ..... A47G 25/005 211/113
4,930,692 A 6/1990 Smilow et al.
4,967,913 A * 11/1990 Bayer ..... A47F 5/0006 211/118
5,110,019 A 5/1992 Kolton et al.
5,123,577 A 6/1992 Kolton et al.
5,222,638 A 6/1993 Kolton et al.
5,328,065 A 7/1994 Kolton et al.
5,501,378 A 3/1996 Kolton et al.
5,582,387 A 12/1996 Kolton et al.
5,615,810 A 4/1997 Kolton et al.
5,826,760 A 10/1998 Kolton et al.
5,911,347 A * 6/1999 Jackstat ..... A47G 25/005 223/85
5,988,462 A 11/1999 Kolton
6,073,758 A 6/2000 Webster et al.
6,206,253 B1 3/2001 Kolton et al.
6,264,077 B1 7/2001 Kolton et al.
6,561,358 B2 5/2003 Kolton et al.
7,143,892 B2 12/2006 Kolton et al.
7,448,520 B2 11/2008 Kolton et al.
8,286,882 B2 10/2012 Norman et al.
8,308,291 B2 11/2012 Norman et al.
8,651,344 B2 2/2014 Norman et al.
9,480,347 B2 11/2016 Strassburger et al.
9,585,496 B2 3/2017 Strassburger et al.
2003/0121817 A1* 7/2003 Hooper ..... A47G 25/005 206/461
2007/0251894 A1* 11/2007 Kelley ..... A47F 7/08 211/34
2009/0071917 A1* 3/2009 Hathorn ..... A47F 5/0006 211/34
2011/0247185 A1* 10/2011 Bolden ..... A47G 25/005 24/716
2016/0058209 A1 3/2016 Strassburger et al.
2016/0058210 A1* 3/2016 Strassburger ..... A47F 7/02 248/340
2016/0223137 A1* 8/2016 Ochipa ..... A47G 25/4046
2016/0302559 A1* 10/2016 Khan ..... A45F 5/02
2017/0253408 A1 9/2017 Strassburger
2018/0087293 A1* 3/2018 Strassburger ..... E05B 69/003
2019/0027008 A1* 1/2019 Strassburger ..... G08B 13/24
2019/0099015 A1* 4/2019 Strassburger ..... B65D 73/0014
2019/0239658 A1 8/2019 Strassburger et al.
2021/0045560 A1* 2/2021 Strassburger ..... A47G 25/40
2021/0106159 A1* 4/2021 DiLorenzo ..... A47F 7/08

* cited by examiner

DISPLAY HANGER FOR SLIDE STYLE SHOES

CROSS-REFERENCE TO RELATED APPLICATION

This application claims priority to U.S. Provisional Patent Application No. 62/736,532, filed on Sep. 26, 2018, the contents of which are incorporated herein by reference in its entirety.

FIELD OF THE INVENTION

The present invention relates to display hangers, and more particularly, to display hangers configured to accommodate and display slide style shoes.

BACKGROUND OF THE INVENTION

In most retail footwear stores, footwear products such as slides are commonly displayed for sale on shoe racks or hung on a hook or the like. Generally, the entire inventory of models and sizes of these footwear products are available in the showroom for customers. It is customary for the customers to try different models and sizes of their choices in the showroom. However, this presents an issue of mixing up of the footwear products since the footwear products are frequently scattered randomly on the showroom floor after the customers try them on.

Accordingly, there is a need for an improved display hanger to prevent mix-up of models and sizes of slide style shoes.

SUMMARY OF THE INVENTION

According to an embodiment of the present invention, a display hanger for slides includes a body member and a holder configured to engage and attach to the body member. The body member includes a display hanger hook, an elongated central member connected to the display hanger, a bottom member connected to the central member, and opposed first and second side members connected to each side of the bottom member and extend laterally therefrom and then extend upwardly such that first and second clips are formed, respectively. The holder has parallel first and second longitudinal side walls and parallel first and second transverse side walls. The longitudinal side walls and transverse side walls are integrally connected to each other to form a generally rectangular frame having an open space in the middle.

The display hanger further includes a bungee cord for keeping the slides with the display hanger while a customer tries them on.

These and other aspects of the present invention will be better understood in view of the drawings and following detailed description.

DETAILED DESCRIPTION OF PREFERRED EMBODIMENTS

Figure 1:
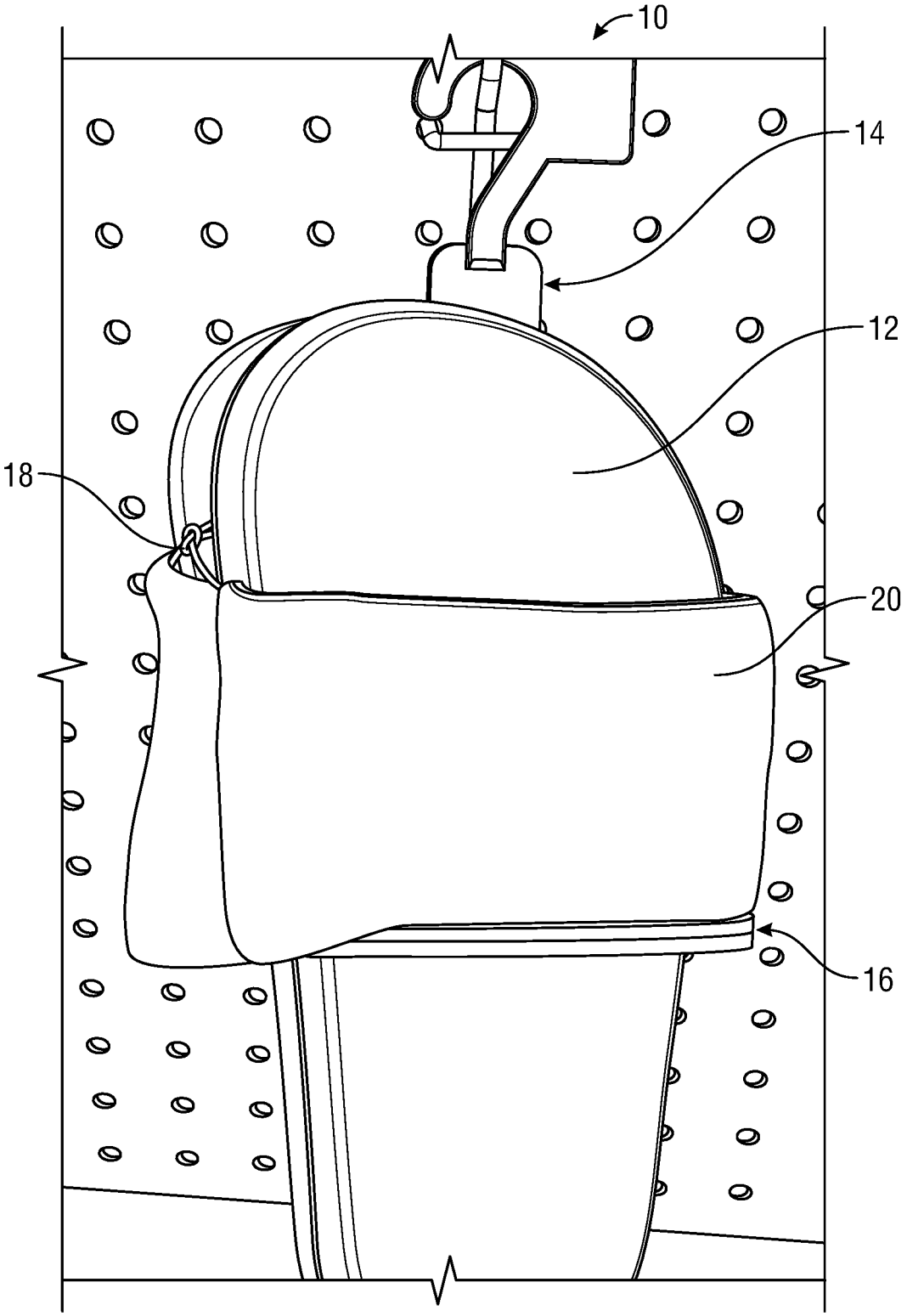
FIG. 1 is a front view of the display hanger, according to an embodiment of the present invention, with slides placed thereonto.
Figure 2:
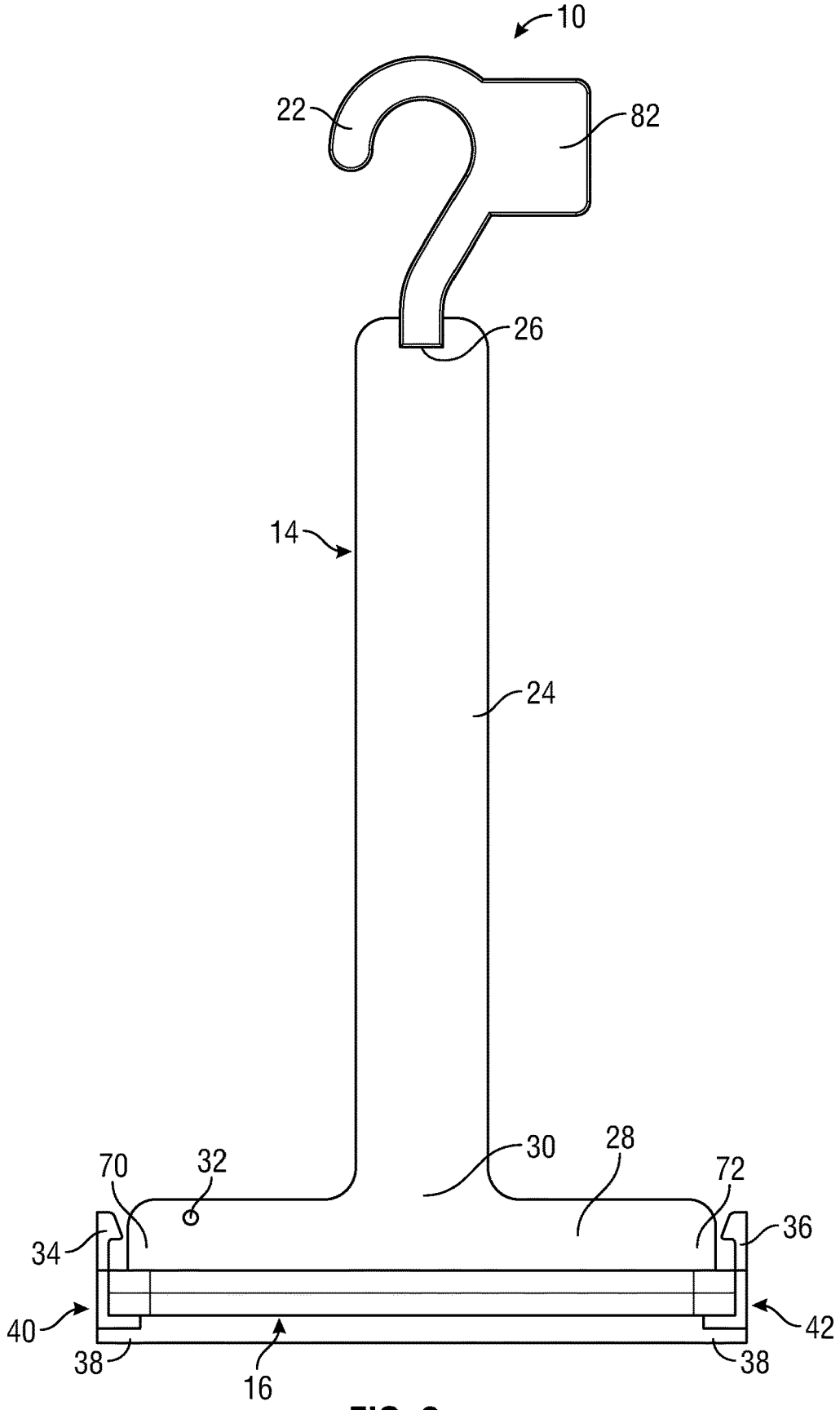
FIG. 2 is a front view of the display hanger.

According to an embodiment of the present invention, referring to FIGS. 1 and 2, there is shown a display hanger 10 configured to engage and accommodate a variety of different shoes, such as slides 12. The display hanger 10 includes a body member 14 and a holder 16 configured to engage and attach to the body member 14, which will be described in greater detail below. The display hanger 10 further includes an elastic cord, such as a bungee cord 18, for keeping the slides 12 together with the display hanger 10 while a customer tries them on.

Directional terms, such as upper and lower are referenced to an orientation in which the display hanger 10, with straps 20 of the slides 12 engaged therewith, is hung on a display hook. However, the present invention is not thereby limited to use in any particular orientation.

Figure 3:
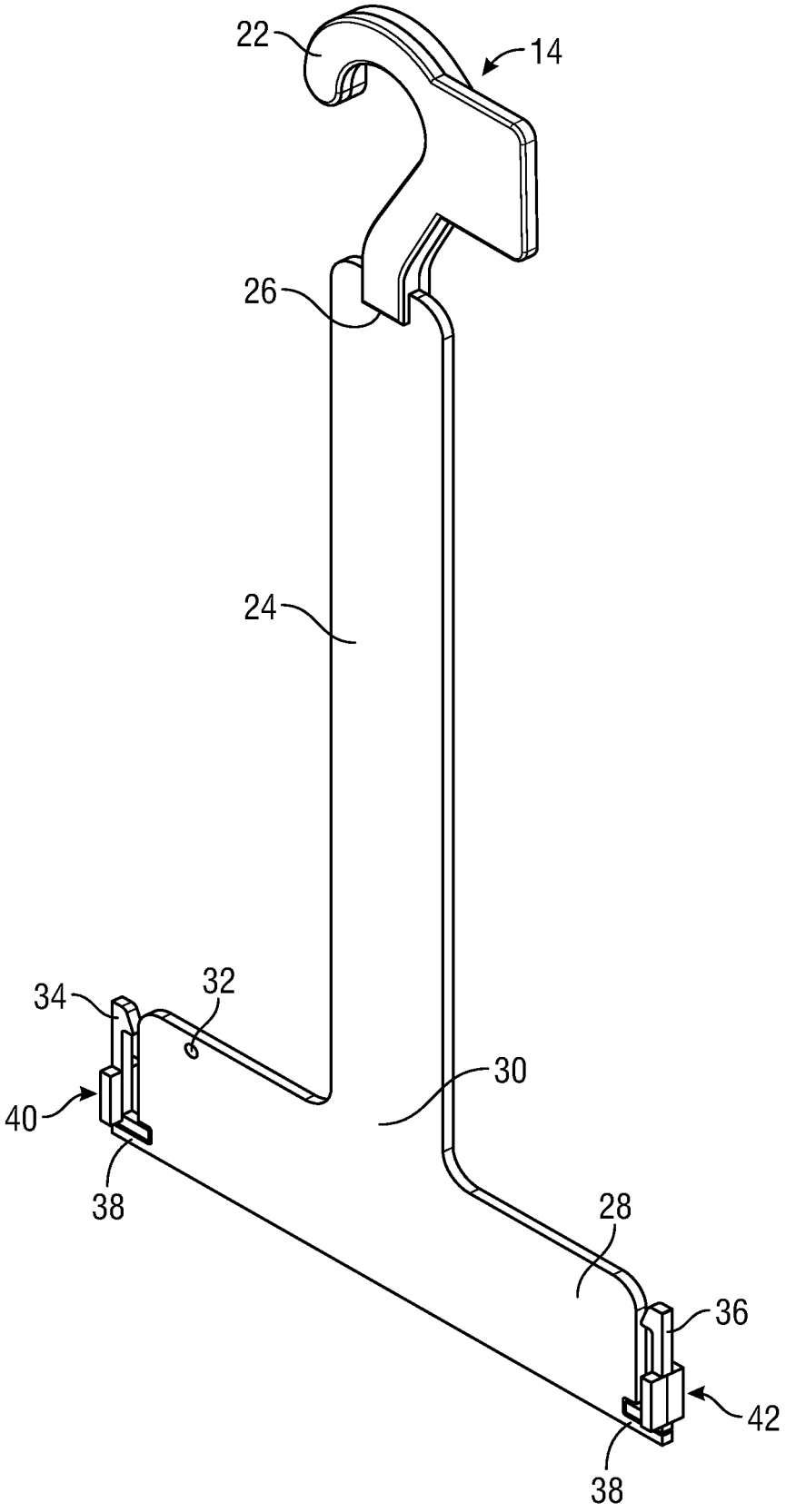
FIG. 3 is a front perspective view of the body member of the display hanger in FIG. 2.
Figure 4:
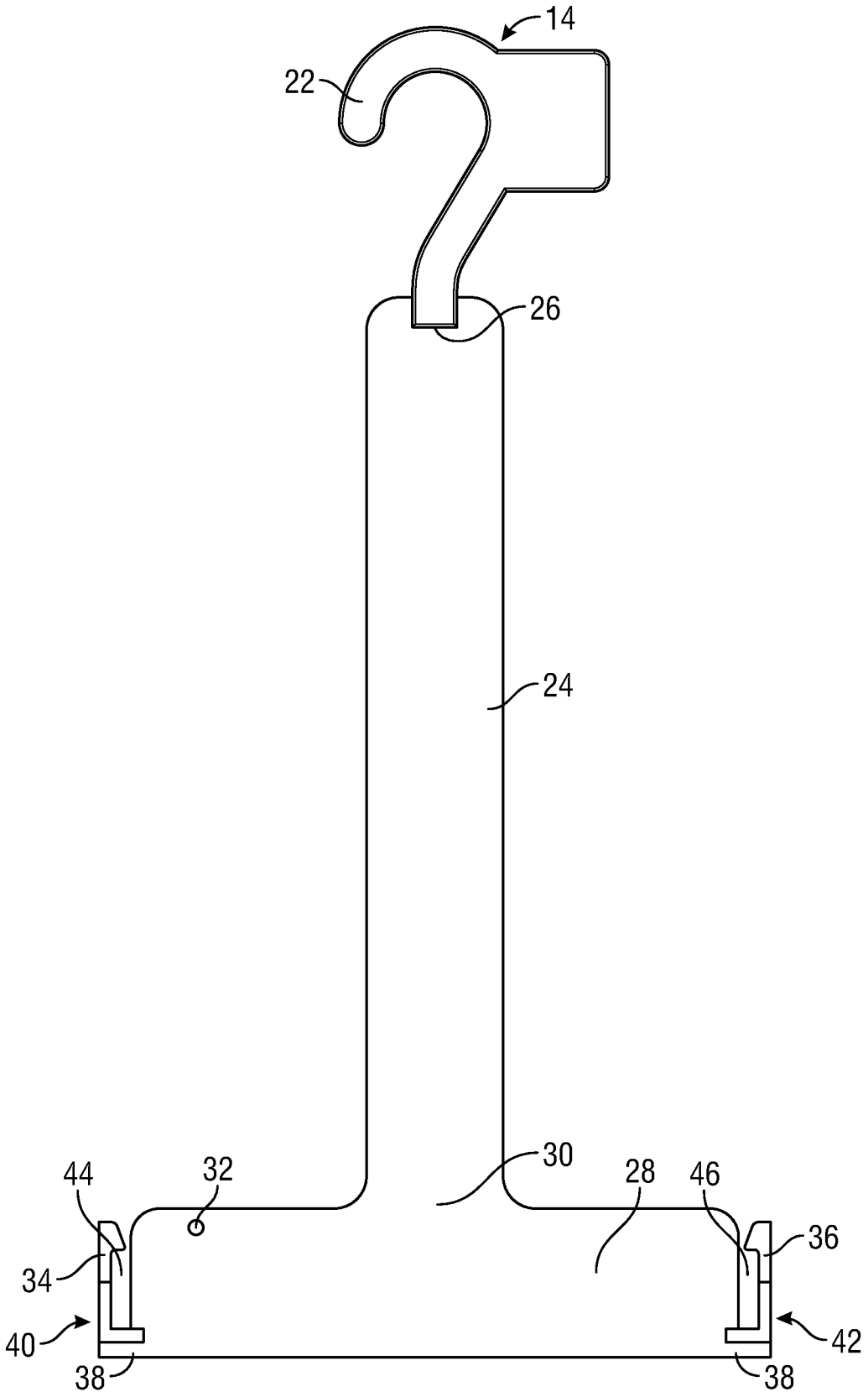
FIG. 4 is a front view of the body member in FIG. 3.

Referring to FIGS. 3 and 4, the body member 14 includes a display hanger hook 22, a generally elongated central member 24 integrally connected to a lower end 26 of the display hanger hook 22 and extending downwardly therefrom, and a generally rectangular bottom member 28 integrally connected to a lower end 30 of the central member 24. The display hanger hook 22 is positioned directly above the central member 24 to provide a mean to engage with a display hook for retail display.

Figure 5:
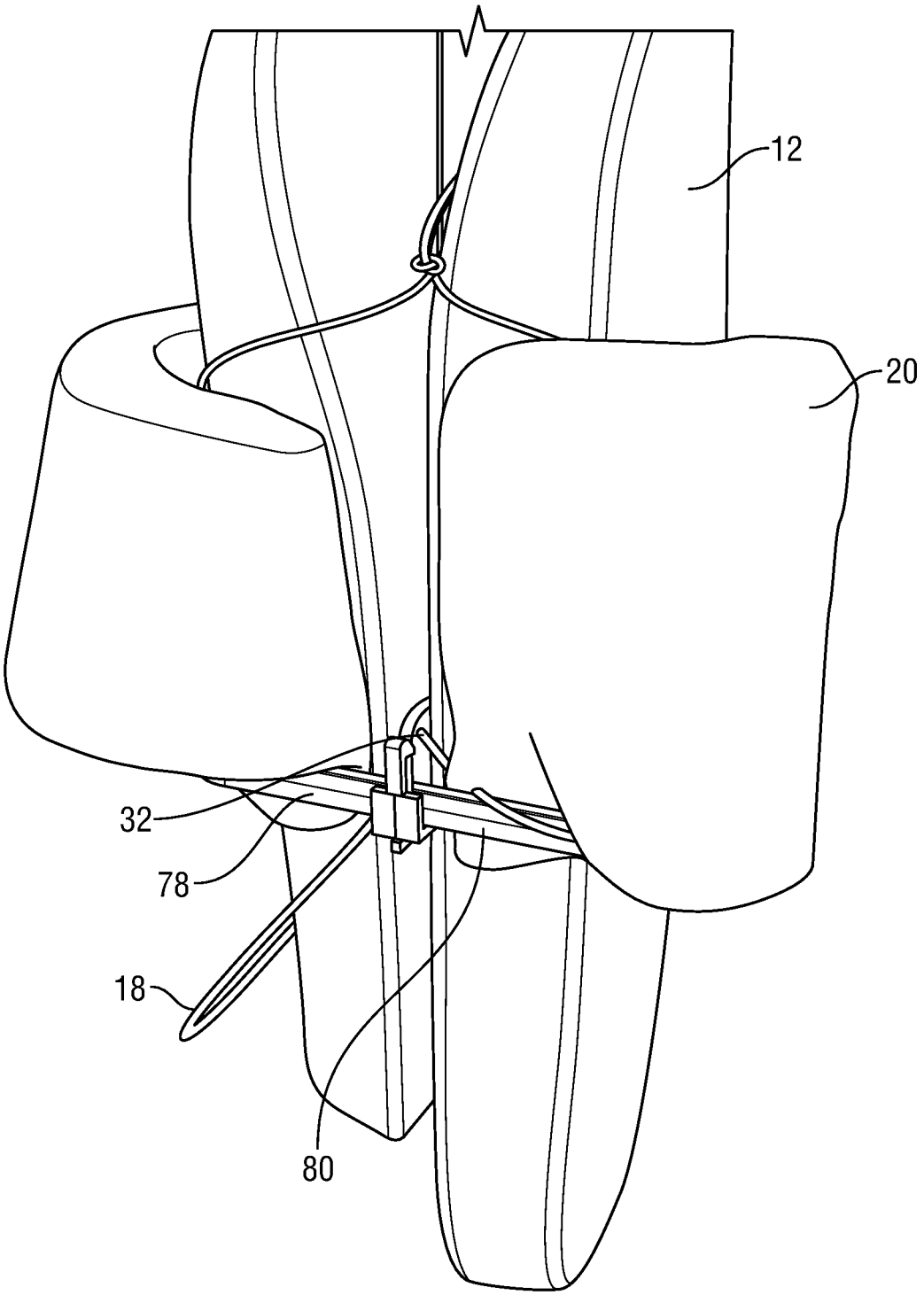
FIG. 5 is a side perspective view of the display hanger in FIG. 1.
Figure 6:
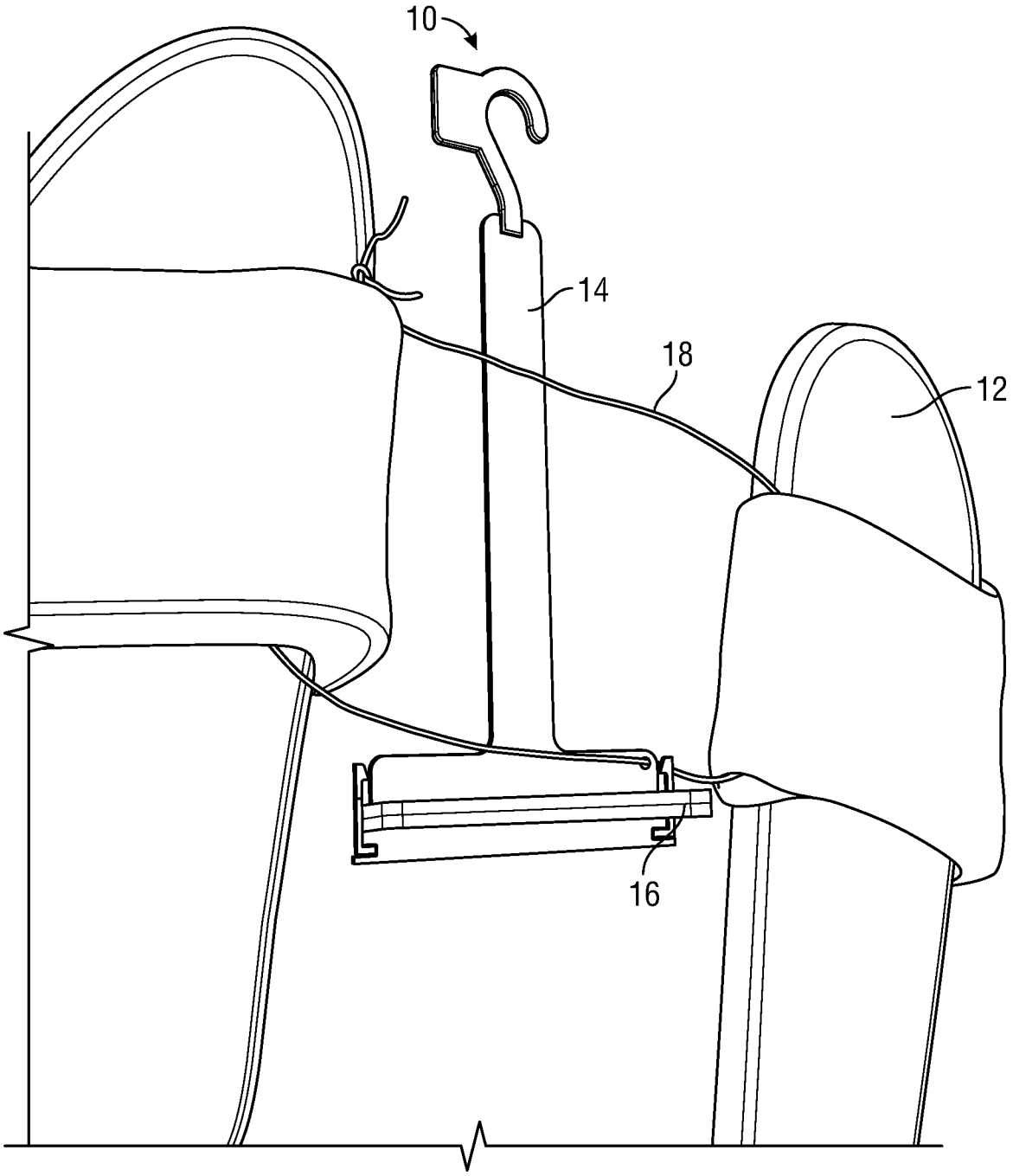
FIG. 6 is a front view of the display hanger in FIG. 1, with a bungee cord tied to the display hanger and the slides.

An aperture 32 is defined in an upper portion of the bottom member 28, through which the bungee cord 18 may be inserted and tie the slides 12 to the display hanger 10, as shown in FIG. 5. Tying of the slides 12 to the display hanger 10 allows a customer to take the slides 12 out from the display hanger 10 and try the slides 12 on without them being completely separated from the display hanger 10 or each other, as shown in FIG. 6.

Referring again to FIGS. 3 and 4, the body member 14 further includes opposed first and second side members 34, 36 that are integrally connected to a lower end 38 of each side of the bottom member 28 and extend laterally therefrom and then extend upwardly such that first and second clips 40, 42 are formed, respectively. The first and second clips 40, 42 include a first cavity 44 and a second cavity 46, respectively. When the holder 16 is attached to the body member 14, a portion of the holder 16 is placed within each of the first and second cavities 44, 46, as will be described in greater detail below.

Figure 7:
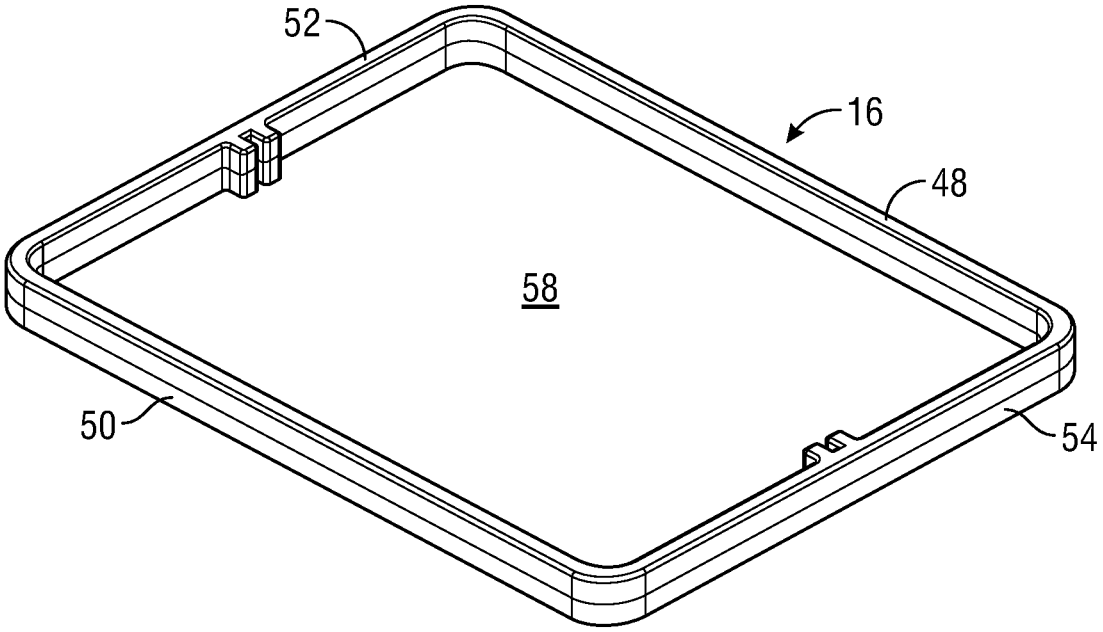
FIG. 7 is a top perspective view of the holder of the display hanger in FIG. 2.
Figure 8:
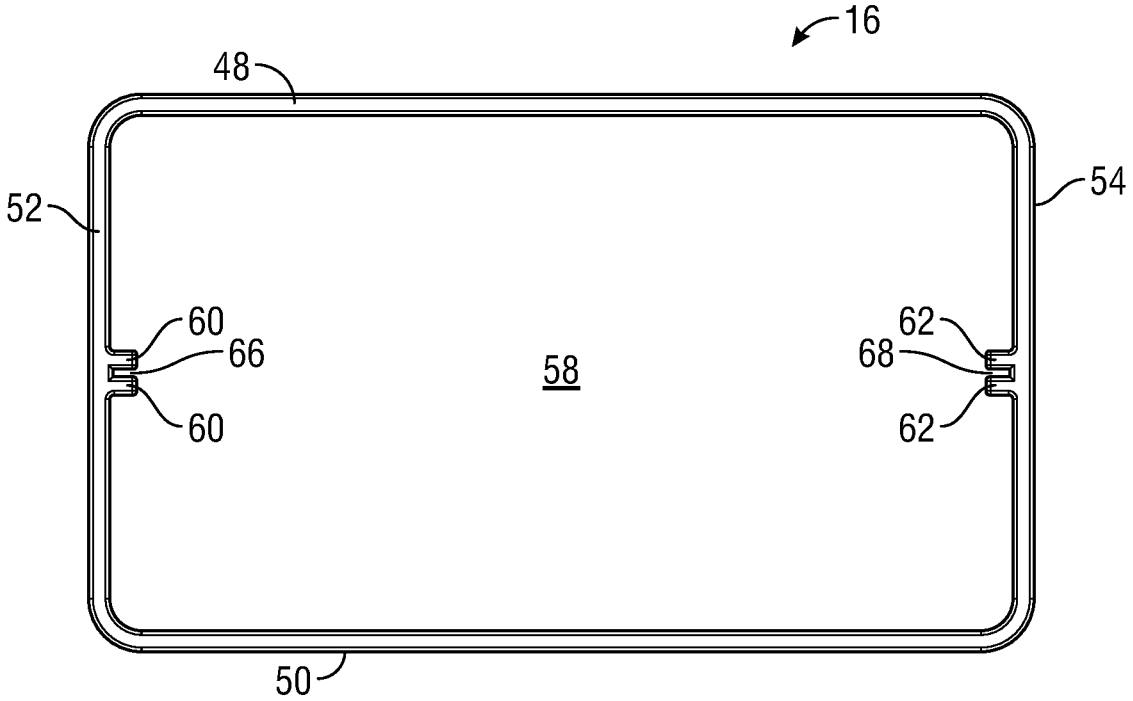
FIG. 8 is a top view of the holder in FIG. 7.

Referring to FIGS. 7 and 8, the holder 16 includes substantially parallel first and second longitudinal side walls 48, 50 and substantially parallel first and second transverse side walls 52, 54, with all the walls 48, 50, 52, 54 having the same thickness. The longitudinal side walls 48, 50 and transverse side walls 52, 54 are integrally connected to each other, such that they form a generally rectangular frame having an open space 58 in the middle.

The holder 16 further includes first and second pairs of tabs 60, 62 that extend from a center of an inner surface 64 of the first and second transverse side walls 52, 54, respectively, with a first gap 66 forming between the tabs 60 of the first pair and a second gap 68 forming between the tabs 62 of the second pair.

The first pair tabs 60 and second pair tabs 62 allow the holder 16 to be attached to the body member 14. Specifically, as shown in FIGS. 2, 6, and 9, the holder 16 may be attached to the body member 14 by inserting first and second side edge portions 70, 72 of the bottom member 28 of the body member 14 into the first and second gaps 66, 68, respectively, and pushing the holder 16 downwardly until the bottom of each tab 60, 62 is met by the bottom of each corresponding clip 40, 42 such that a portion of each transverse wall 52, 54 is disposed in the first and second cavities 44, 46 of the first and second clips 40, 42.

The tabs 60, 62 and gaps 66, 68 are configured and dimensioned such that the side edge portions 70, 72 of the bottom member 28 of the body member 14 may be closely accommodated within the gaps 66, 68, allowing the holder 16 to slide up and down along the side edge portions 70, 72 of the bottom member 28.

Figure 9:
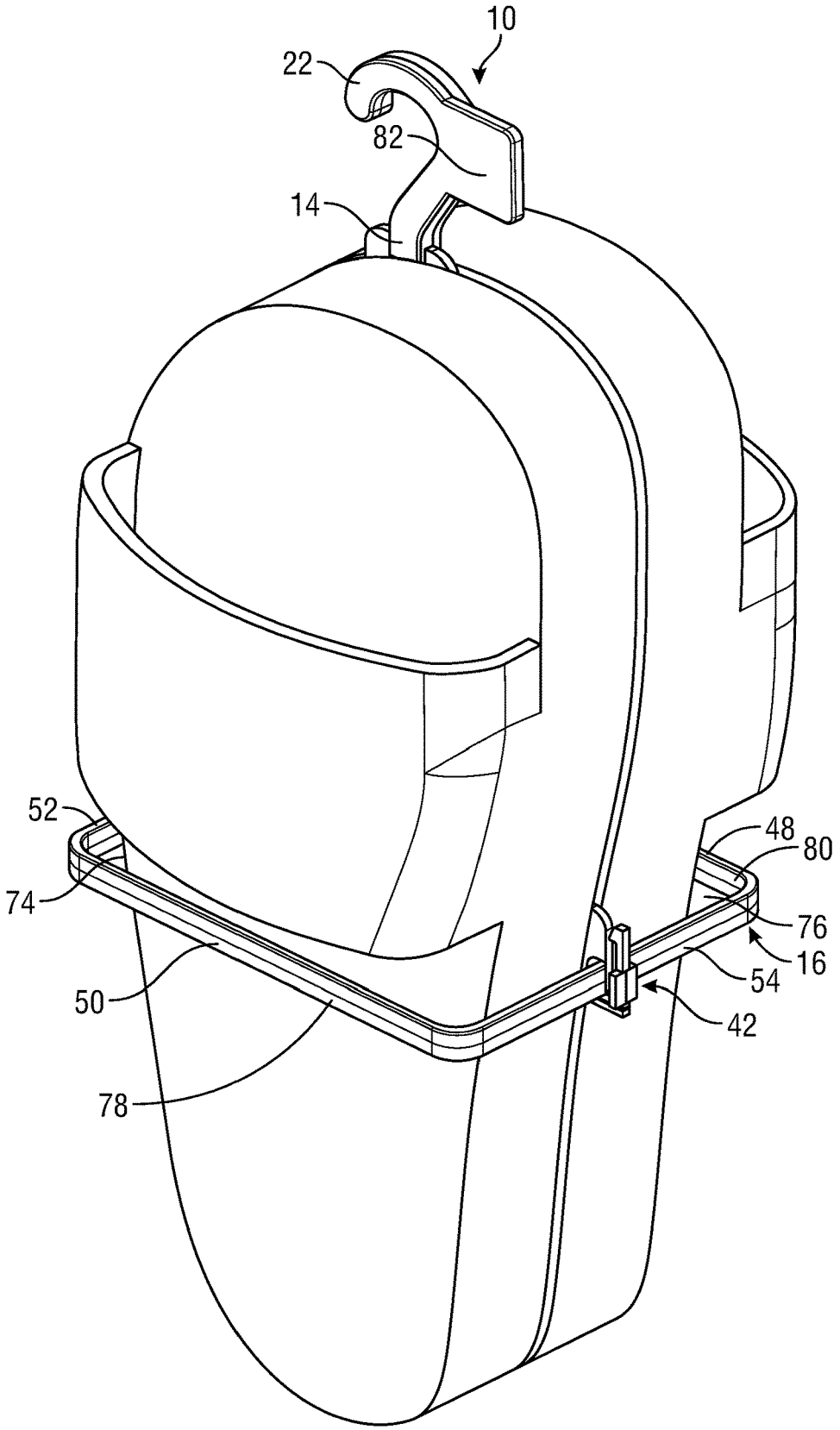
FIG. 9 is a front perspective view of the display hanger with slides placed thereonto.

Once the holder 16 is attached and firmly placed onto the body member 14, the open space 58 of the holder 16 is divided into two equal spaces 74, 76 for each slide 12 to be vertically positioned therethrough with first and second portions 78, 80 of the holder 16 encircling the slides 12, as shown in FIG. 9. Each encircling portion 78, 80 allows the strap 20 of the slides 12 to be rested thereon, thereby, providing a support for the slide 12 and allowing the slide 12 to be remained in a vertical position, as shown in FIG. 5.

Referring again to FIG. 2, the display hanger 10 further includes a label member 82 integrally connected to the display hanger hook 22. The label member 82 provides convenient surfaces for pictures such as logos or text (including product descriptions) to be printed on, embossed in, or otherwise attached.

In the depicted embodiment, the label member 82 is connected to the side of the display hanger hook 22. Alternatively, the label member 82 could be integrally formed on top of the display hanger hook 22.

The display hanger 10 is made out of one or more materials having suitable properties for a desired application, including strength, weight, rigidity, etc. Plastic is generally preferred. It will be appreciated that other designs and configurations could be used for the footwear security display hanger 10, as deemed suitable for a given application factors.

From the foregoing, it will be appreciated that a footwear security display hanger according to the present invention may be used to prevent mix-up of footwear products, as well as for anti-theft, while providing a design that is convenient for merchants to display their goods.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A display hanger for slides, the display hanger comprising:

a body member including a display hanger hook, an elongated central member extending downwardly from a lower end of the display hanger hook, a bottom member connected to a lower end of the central member, and opposed first and second side members that are connected to a lower end of each side of the bottom member and extend laterally therefrom and then extend upwardly such that first and second clips are formed, respectively; and a holder configured to be wedged between the first and second clips to attach the holder to the body member, the holder having substantially parallel first and second longitudinal side walls and substantially parallel first and second transverse side walls, the longitudinal side walls and transverse side walls integrally connected to each other to form a generally rectangular frame having an open space in the middle that is configured to receive the slides.

2. The display hanger of claim 1, wherein the holder further includes first and second pairs of tabs that extend from a center of an inner surface of the first and second transverse side walls, respectively, with a first gap forming between the tabs of the first pair and a second gap forming between the tabs of the second pair.

3. The display hanger of claim 2, wherein, the holder is attached to the body member by inserting first and second side edge portions of the bottom member of the body member into the first and second gaps, respectively, and pushing the holder downwardly until the bottom of the corresponding tab is met by a bottom of the corresponding clip.

4. The display hanger of claim 3, wherein the holder can slide up and down along the side edge portions of the bottom member.

5. The display hanger of claim 1, wherein, when the holder is attached to the body member, the open space of the holder is divided into two equal spaces for each slide to be vertically positioned therethrough with the longitudinal side walls of the holder encircling the slides.

6. The display hanger of claim 5, wherein each of the longitudinal side walls allows a strap of a corresponding slide to be rested thereon, thereby, providing a support for the corresponding slide and allowing the corresponding slide to be remained in a vertical position.

7. The display hanger of claim 1, wherein the display hanger further comprises a bungee cord to keep the slides connected to the display hanger while a customer tries the slides on.

8. The display hanger of claim 7, wherein an aperture is defined in an upper portion of the bottom member, through which the bungee cord is inserted to tie the slides to the display hanger.

9. The display hanger of claim 1, wherein the display hanger hook provides a mean to engage with a display hook of a retail display.

10. The display hanger of claim 1, wherein the display hanger is made out of plastic.

11. The display hanger of claim 1, the display hanger further comprises a label member.

12. The display hanger of claim 11, wherein the label member is connected to the display hanger hook.

* * * * *